US006732745B2

(12) United States Patent
Hester

(10) Patent No.: US 6,732,745 B2
(45) Date of Patent: May 11, 2004

(54) HAIR CURLING APPARATUS

(76) Inventor: Ann Maria Hester, 5649 Columbia Rd. #301, Columbia, MD (US) 21044

( * ) Notice: Subject to any disclaimer, the term of this patent is extended or adjusted under 35 U.S.C. 154(b) by 81 days.

(21) Appl. No.: 10/056,202

(22) Filed: Jan. 25, 2002

(65) Prior Publication Data

US 2002/0134397 A1 Sep. 26, 2002

Related U.S. Application Data

(60) Provisional application No. 60/264,146, filed on Jan. 25, 2001.

(51) Int. Cl.[7] ..... A45D 2/12; A45D 7/00

(52) U.S. Cl. ..... 132/226; 132/210

(58) Field of Search ..... 132/207, 210, 132/211, 237, 226, 243, 246, 241, 331, 333, 332, 236, 240, 242, 253; D28/10, 11, 37, 38

(56) References Cited

U.S. PATENT DOCUMENTS 1,849,543 A * 3/1932 Gadd ..... 132/118
2,281,853 A * 5/1942 Miller ..... 132/224
3,433,233 A * 3/1969 Thackeray ..... 132/251
4,216,787 A * 8/1980 Moea ..... 132/250
4,261,375 A * 4/1981 Anderson ..... 132/224
4,327,754 A * 5/1982 Hildreth ..... 132/241
4,644,965 A * 2/1987 Alexander ..... 132/253
4,867,185 A * 9/1989 Clingen ..... 132/225
4,898,194 A * 2/1990 Einspahr ..... 132/251

* cited by examiner

*Primary Examiner*—Kevin Shaver
*Assistant Examiner*—David Comstock

(57) ABSTRACT

A hair curling apparatus provides a frame having an open center that includes a frame (preferably rectangular or square) having an open center, the frame having preferably lateral sides, but at least a lower surface that is shaped (as arcuately) to conform generally to the head of a user and an upper surface that provides a plurality of receptacles thereon which receives one or more hair curlers. A plurality of rollers may removably attach to the frame, the roller occupying the open center of the frame. Each roller has opposed end portions that engage receptacles on the frame when the roller is attached thereto. A majority of the length of each roller occupies the open center during use. Preferably, the rollers also exhibit a curved or arcuate profile in one longitudinal plane such that they also conform to the head of the user when the rollers are inserted into the frame. The curlers can be selectively oriented either longitudinally or laterally upon the frame.

9 Claims, 4 Drawing Sheets

HAIR CURLING APPARATUS

CROSS-REFERENCE TO RELATED APPLICATIONS

This application claims priority of Provisional Patent Application Serial No. 60/264,146, filed Jan. 25, 2001.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to hair curling devices and more particularly to an improved hair curling apparatus that features a specifically configured frame having an open center portion that is receptive of a plurality of curler rollers, the end portions of the curlers having locking members that interlock with the frame at selected positions on the frame.

2. General Background of the Invention

Hair curler devices have commonly been used to curl the hair of a user when left in place over a period of time. However, such curlers are typically uncomfortable for a user if left in the user's hair for a long period of time such as when sleeping.

One of the most common types of curling devices is a single curler having an attachment that spans between the ends of the curler to strap the user's hair in place. Such a self supporting single curler is shown in the Smith U.S. Pat. No. 365,449 entitled "Hair Curler".

Some individual hair curlers have straps or bands that grip the hair and hold it against the curler roller, once the hair is fully rolled on the curling roller. An example can be see in the Gosewisch U.S. Pat. No. 2,061,356 entitled "Hair Waver". In that patent, the curler provides a core wrapped with a cover of paper, fabric, leather or a synthetic pliable material. An elastic band extends from end to end of the body of the device and is secured at each end by a wrapping which also pinches the covering material to close the ends of the core.

The Buchanan U.S. Pat. No. 2,603,225 discloses an appliance that is said to prevent frizzling and kinking of hair during permanent waving operation.

The Hildreth U.S. Pat. No. 4,327,754 discloses a permanent wave accessory, including a base implement for presectioning of hair, the base implement being comfortable to the scalp contour and positionable in a spaced apart relation from the scalp; roller means for receiving hair as presectioned by the base implement, such roller means being axially deformable in accordance with the scalp contour as assumed by the base implement; and means for mounting the roller means side-by-side along the base implement and which may cooperatively interact with the roller means for maintaining the roller means at a given position of rotation as interconnected therewith.

In the Beier U.S. Pat. No. 4,592,375, there is disclosed an elongated, cylindrical hair curling roller comprised of polyester fibers adhesively secured together so that the roller will yieldably retain its cylindrical shape and density. Preferably, the fibers are coated with a latex material which binds the fibers together.

In the Wiggin U.S. Pat. No. 4,699,160 there is disclosed a hair curling rod assembly consisting of an elongated hollow rod molded of thermoplastic material and having one closed end and an opposite open end. The open end of the rod has a cylindrical opening and the closed end of the rod has an axial hole in the center of its closed end. A hair tress-fastening cord of stretchable elastomeric material passes through the axial hole at the closed end of the rod with the end of the cord lying within the hollow rod being knotted so as to secure it within the rod.

The Vogelzang et al. U.S. Pat. No. 4,936,323 discloses a hair curler comprising a roller and a support therefor. The support includes jaws which permit the roller to slide along between an entrance position in which the roller is freely rotatable, and a grasping position which permits final adjustment of hair tension on the roller. The support includes a comb, and hair tension locks the comb in position on the scalp.

In U.S. Pat. No. 5,186,187 there is provided a hair roller that provides for the use of a cylindrical tube rolled from a rectangular perforated sheet of flexible material. The sheet has an outer edge which overlaps a portion of the tube. The tube has a pair of opposing transverse edges, each of which is engaged within a spiral groove formed in opposing caps. The caps are rotationally mounted on an elongated shaft, such that rotation of the disks causes advancement of the transverse edges within the spiral groove, changing the diameter of the outer tube, as desired. An indicia on the outer surface of one or two caps allows to select the diameter of the tube when rotating the caps. The shaft has slotted projections on opposing ends with one or both of which an elongated resilient band is engaged.

Most of these prior art patents relate to single roller constructions rather than to a frame that is fitted to the head of a user and which accepts one or more rollers that removably attach to the frame. One patent does disclose a frame with closely spaced partitions that define close spacing for segments of hair. The present invention provides a frame that allows horizontal and vertical rollers of different sizes to be fitted thereto because there is no separating parts to partition the hair. There is therefore a greater flexibility in roller placement and in the amount of hair that can go to a selected roller.

BRIEF SUMMARY OF THE INVENTION

The present invention thus provides an improved hair curling apparatus that includes a frame (preferably rectangular or square) having an open center, the frame having preferably lateral sides, but at least a lower surface that is shaped (as arcuately) to conform generally to the head of a user and an upper surface that provides a plurality of receptacles thereon.

A plurality of rollers are provided that removably attach to the frame, the roller occupying the open center of the frame. Each roller has opposed end portions that engage receptacles on the frame when the roller is attached thereto. A majority of the length of each roller occupies the open center during use. Preferably, the rollers also exhibit a curved or arcuate profile in one longitudinal plane such that they also conform to the head of the user when the rollers are inserted into the frame.

The frame is preferably of a soft material such as foam, rubber, or soft plastic, enabling a user to sleep while the frame is in place. While sleeping, it rolls her hair.

At least the underside of the frame can be made of a flexible material that conforms to the contours of the user's head.

The frame can be any selected shape but is preferably rectangular or square.

The frame open center can be any shape but is preferably rectangular or square.

The rollers are removably attachable to the frame and preferably in parallel fashion so that a number of closely spaced apart rollers can be attached to the frame, each one generally parallel to the one next to it.

The frame preferably provides receptacles thereon that enable rollers to be attached to the frame in various positions as selected by a user.

The frame preferably has a first pair of generally parallel side walls and a second pair of generally parallel side walls.

The frame preferably provides receptacles on the side walls of the frame. Receptacles can be provided that enable the rollers to be placed side-by-side and can be parallel if desired.

The method of the present invention includes the providing of a frame that can be fitted to the head of a user, the frame having a generally open center through which a portion of the user's hair can be passed and then fitted with a roller. The method contemplates the curling of a selected lock of hair that has passed through the open center of the frame to a selected roller. The rollers can include rollers of different sizes (such as different diameters), enabling a user flexibility in the amount of hair that can be rolled to a particular roller. The rollers can be of a cylindrical core of foam or soft rubber covered with fabric.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 2:
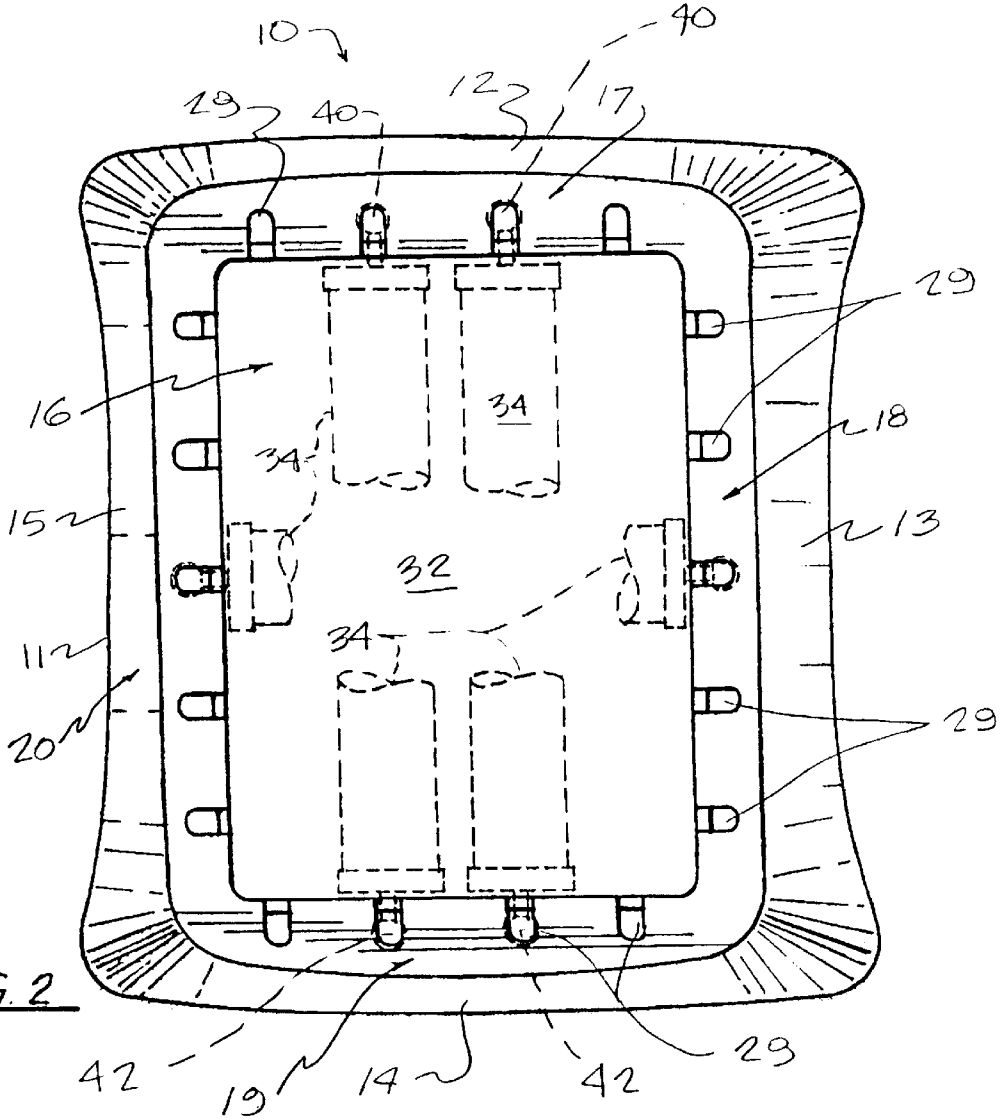
FIG. 2 is a partial plan view of the preferred embodiment of the apparatus of the present invention.
Figure 1:
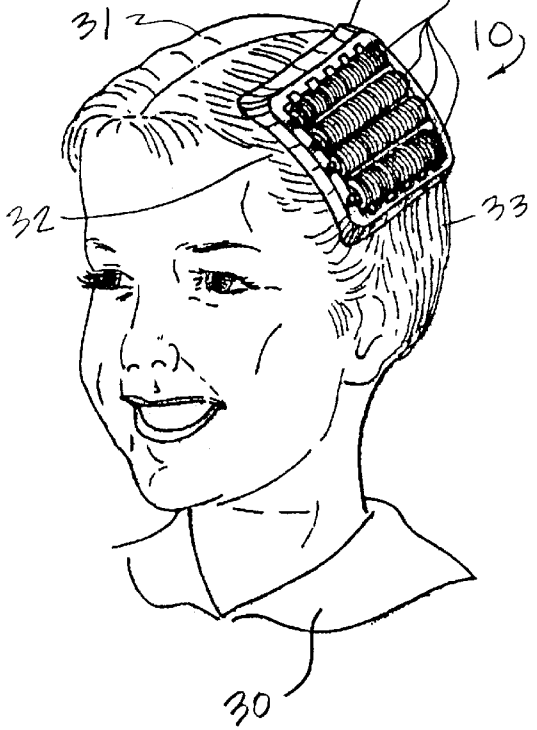
FIG. 1 is a perspective view of the preferred embodiment of the apparatus of the present invention.

FIGS. 1–2 show generally the preferred embodiment of the apparatus of the present invention designated generally by the numeral 10. Hair curling apparatus 10 includes a frame 11 that can be fitted to the head 31 of a user 30, conforming generally to the user's scalp 32.

The frame 11 provides an open center portion 16 through which a portion of the user's hair 33 can be extended. A selected portion of the hair 33 can then be curled upon a selected roller. For example, in FIG. 1, a portion of the user's hair 33 has passed through the open center portion 16 and then divided into four locks of hair, each lock wound or curled upon a roller 34 (or 44 or 57—see FIGS. 1 and 5–9).

One of the advantages of the present invention is that different types of rollers 34,44, 57 and rollers of differing diameters can be used with the frame 11, enabling the user to curl a selected portion of hair 33 upon a selected roller.

Figure 4:
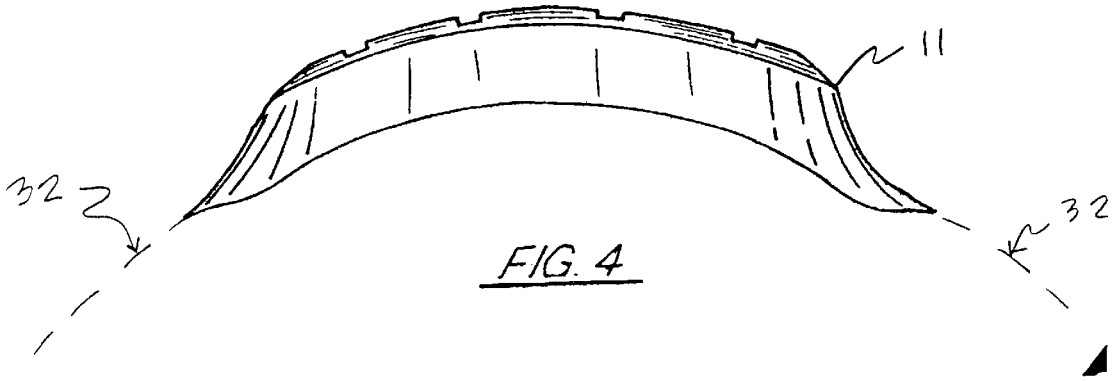
FIG. 4 is a partial side view of the preferred embodiment of the apparatus of the present invention illustrating the frame portion.

Frame 11 can be comprised of a plurality of walls or a single peripheral wall. In the preferred embodiment, the frame 11 is generally rectangular or square in shape, providing walls 12, 13, 14, 15. Each of the walls 12–15 has an upper surface. The wall 12 has upper surface 17, wall 13 providing upper surface 18, wall 14 providing upper surface 19 and wall 15 providing upper surface 20. Likewise, each of the walls 12–15 provides a respective lower surface 21–24 as shown in the drawings. As illustrated in FIG. 4, frame 11 as viewed laterally includes curved or generally arcuate opposite walls 12, 14 and 13, 15 (FIG. 1), such that frame 11 readily conforms to the head of the user.

Figure 3:
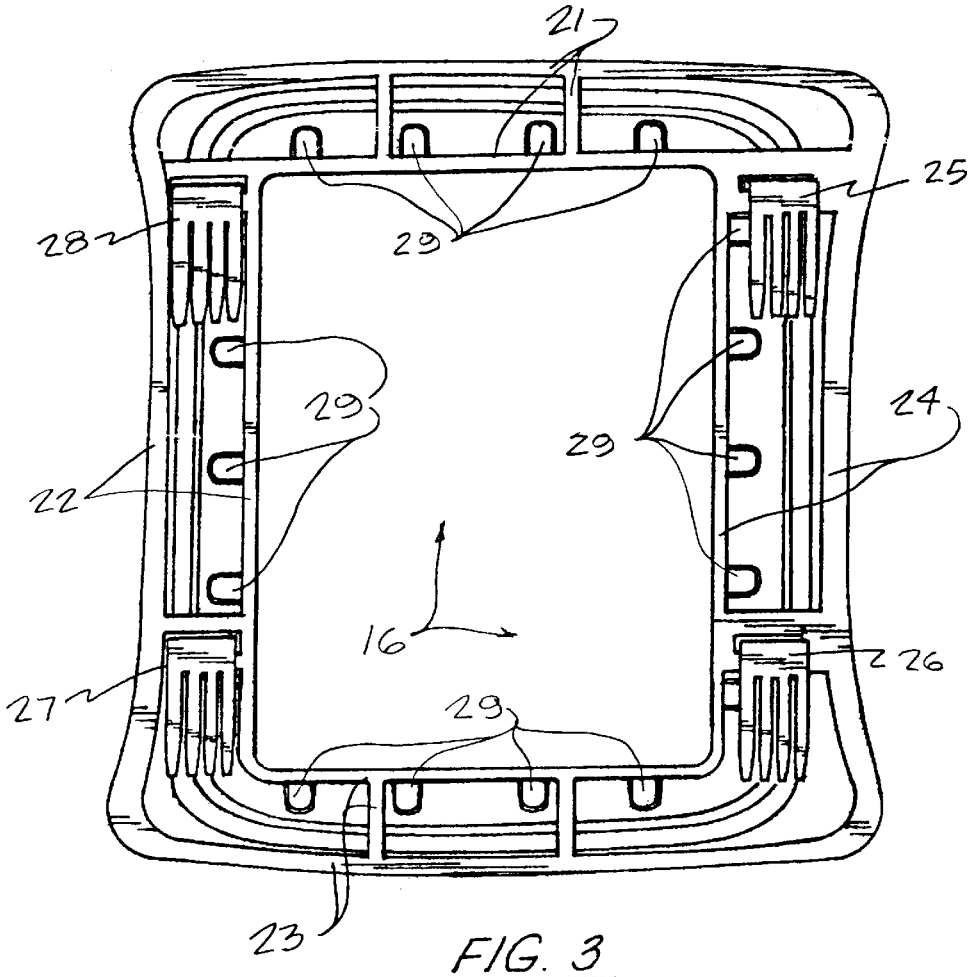
FIG. 3 is a partial, bottom view of the preferred embodiment of the apparatus of the present invention illustrating the frame portion.

The frame 11 has a plurality of combs 25, 26, 27, 28 that are mounted on the underside of the frame as shown in FIG. 3. The combs 25, 26, 27, 28 are mounted in spaced apart relationship, such as for example, at the corners of the frame 11 as shown in FIG. 3. These combs enable a user to anchor the frame 11 to the user's hair 33.

Frame 11 provides a plurality of attachment portions that are receptive of a corresponding attachment portion on the end of a roller. In the preferred embodiment, this attachment portion on the frame can be in the form of a receptacle 29 (see FIGS. 2, 3 and 10–13). In the preferred embodiment, the receptacle 29 is in the form of a socket that communicates with the upper surfaces 17, 18, 19, 20 respectively of the walls, 12, 13, 14, 15.

A plurality of rollers can preferably be removably attached at selected positions to frame 11 as shown in FIGS. 2 and 10–13. In FIGS. 5–9, the rollers are shown more particularly and can include different roller configurations such as the roller 34 shown in FIG. 7, the roller 44 shown in FIG. 8, or the roller 57 shown in FIG. 9.

Figure 7:
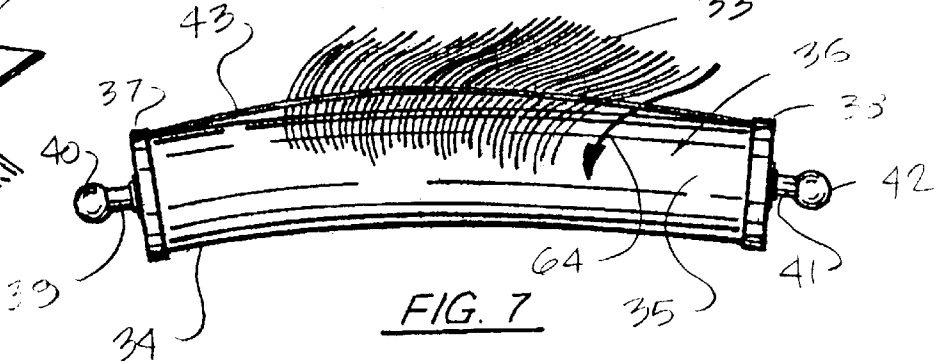
FIG. 7 is a partial perspective view of the preferred embodiment of the apparatus of the present invention illustrating one form of roller that can be attached to the frame.

In FIG. 7, roller 34 includes a cylindrically shaped body 35 having an outer surface 36. It is preferable that outer surface 36 be of a smooth texture with respect to the hair such that the air does not catch or cling to the surface 36. Should the roller body be constructed of such as a foamed rubber or plastic, the smooth surface may be achieved by covering body 35 with a slick material such as satin. A pair of end plates 37, 38 can be fastened to cylindrically shaped body 34, each plate 37, 38 having a connecting portion for connecting to a receptacle that is comprised of stem 39 and ball 40 (or stem 41 and ball 42). A selected portion of hair 33 of the user 30 can be placed under band 43 (see arrow 64)

as shown in FIG. 7 so that the hair 33 is secured to the roller 34 as shown by the arrow 64 in FIG. 7. Once the lock of hair 33 is secured with band 43, the user then curls the hair 33 about the roller cylindrically shaped body 35 and connects the opposing ball 40, 42 and stem 39, 41 portions to selected opposed receptacles 29 on frame 11 such as is shown in FIG. 2.

For example, in FIG. 2 there are two rollers 34 schematically illustrated in phantom lines, each having connected end portions that include a stem 39 and ball 40 and an additional stem 41 and ball 42. In FIG. 2, two of the rollers 34 are shown in phantom lines connected to receptacles 29 at wall 12 and to wall 14. FIG. 2 illustrates selective placement of one or more rollers 34 spanning between wall 12 and wall 14. In FIG. 2, there is also a schematic illustration of roller placement (in phantom lines) spanning from wall 13 to wall 15. Thus, a selected roller such as any of the rollers shown in FIGS. 5–9 can be placed in either a longitudinal direction, spanning between walls 12 and 14, or in a transverse direction spanning between walls 13 and 15. In the direction that spans between walls 12 and 14 in FIG. 2, there are four receptacles 29 at each of the walls 12, 14, thus defining four different positions for a selected roller 34, 44, 57. Either one, two, three or four rollers could be spanned between walls 12 and 14.

It should also be noted that in a preferred form of the invention, as also illustrated in FIG. 7, roller 34 along its longitudinal axis connecting opposing stems 39, 41 and balls 40, 42 is arcuate to a degree generally equal to the profile of frame 11 (illustrated in FIG. 4). By providing an arcuate longitudinal axis for rollers 34, they may be aligned in frame 11 so as to better conform to the head of the user than prior hair curling apparatus. Further improving the ability of the roller 34 to conform to the head of the user is the fabrication of the roller 34 of resilient materials such that it too may bend and adopt the profile of the user's head when roller 34 is installed into frame 11.

Alternatively, if a user selects a transverse direction for the rollers, there are five receptacles 29 on each of the walls 13 and 15 as shown in FIG. 2. In a transverse direction, the frame 11 can receive one, two, three, four or five rollers spanning between walls 13 and 15 though only one roller is illustrated in FIG. 2.

Figure 8:
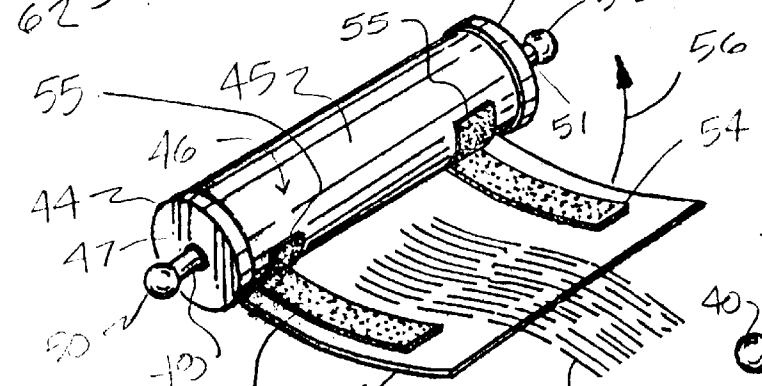
FIG. 8 is another partial perspective view of the preferred embodiment of the apparatus of the present invention illustrating an additional construction for a roller that can be attached to the frame.
Figure 10:
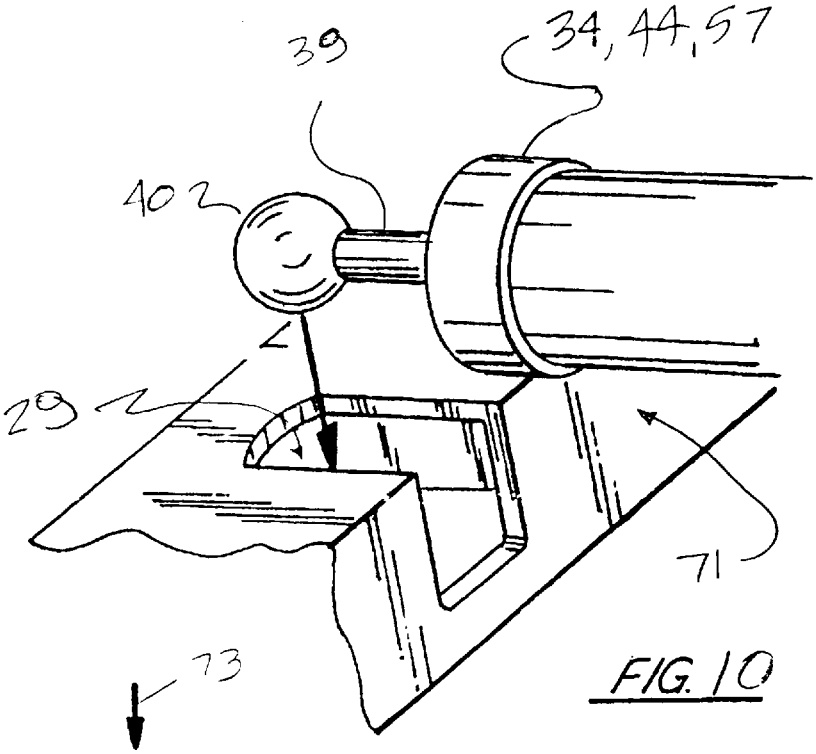
FIG. 10 is a partial, perspective view of the preferred embodiment of the apparatus of the present invention illustrating an attachment of a roller to the frame.
Figure 11:
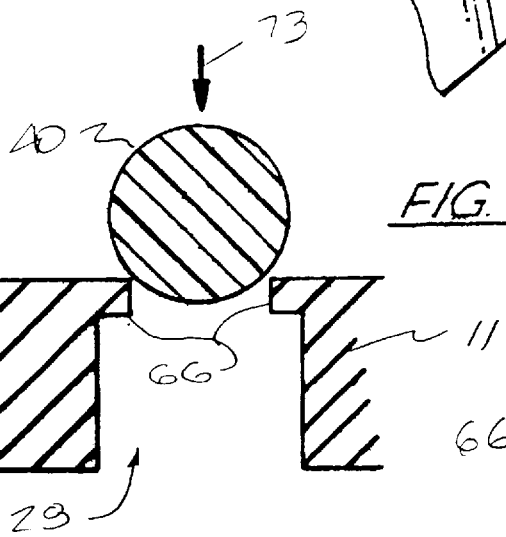
FIGS. 11–13 are sectional fragmentary views of the preferred embodiment of the apparatus of the present invention and illustrating attachment of a roller to the frame.

Roller 44 is shown in FIG. 8 as including a cylindrically shaped body 45 having outer surface 46. As with roller 34, the cylindrically shaped body 45 has end plates 47, 48 each having a stem and ball that define a connector for attaching to a receptacle 29. The end plate 47 has stem 49 and ball 50. The end plate 48 has stem 51 and ball 52.

In FIG. 8, a sheet 53 of material such as a fabric material is provided that can be rolled about the cylindrically shaped body 45 as shown by arrow 56. The sheet 53 has strips 54 of loop material whereas the outer surface 46 of the cylindrically shaped body 45 has strips 55 of hook material. Such a hook and loop or Velcro® attachment enables the sheet 53 to be wrapped about the roller cylindrically shaped body 45, holding a length of hair 33 in between the sheet 53 and the outer surface 46 of the roller body 45.

Figure 9:
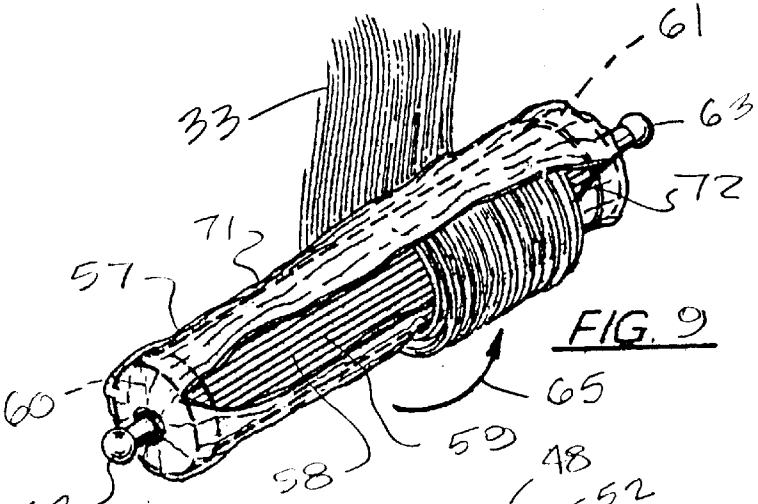
FIG. 9 is another partial perspective view of the preferred embodiment of the apparatus of the present invention illustrating yet another roller construction that can be attached to the frame.

In FIG. 9, the roller 57 has a cylindrically shaped body 58 with an outer surface 59.

Each of the end plates 60, 61 provides an attachment 62, 63 respectively. Each attachment 62, 63 can be comprised of a stem and ball as with the roller shown in FIGS. 7–8 and 10–13.

A fabric cover 71 envelopes most of the outer surface 59 of cylindrically shaped body 58 as shown in FIG. 9. Fabric cover is preferably of a satin or satin-like smooth material, against which the hair will slide and not catch or snag. Certain types of hair are known to be more brittle than others, and I have found that the inclusion of such as a satin cover over the roller 34 outer surface 59 to be a material improvement in the overall performance of curler apparatus 10, particular if worn for prolonged periods of time. A gap 72 enables a selected length of user's hair 33 to be inserted into the space that is formed in between fabric cover 71 and outer surface 59 of cylindrically shaped body 58. Arrow 65 schematically illustrates the placement of hair 33 into slot 72 and about the outer surface 59 of roller body 58. In a preferred embodiment of the roller34 of FIG. 9, fabric 71 may completely encircle the roller body 58, similar to the sheet 53 and be permanently secured to the end plates 60,61 by such as and adhesive, or by such as entrapping the edge of fabric 71 under the cylindrical edges of end plates 60,61 whereby opening 72 is formed by the end edge of the fabric 71 overlapping the adjacent layer of fabric 71, forming a slot allowing the hair 33 to be inserted therein.

Figure 5:
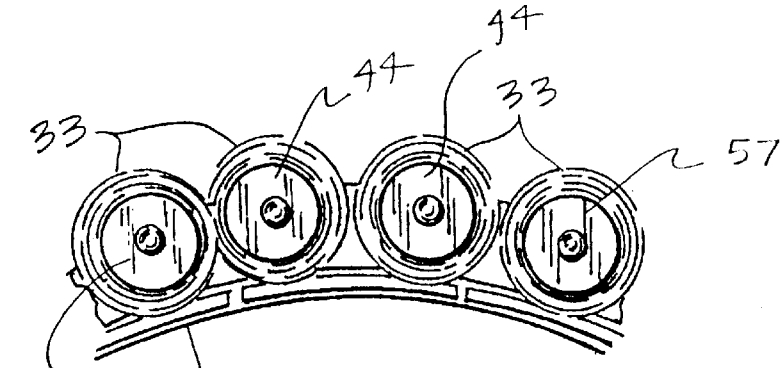
FIG. 5 is a partial end view of the preferred embodiment of the apparatus of the present invention illustrating a part of the frame and a plurality of rollers.
Figure 6:
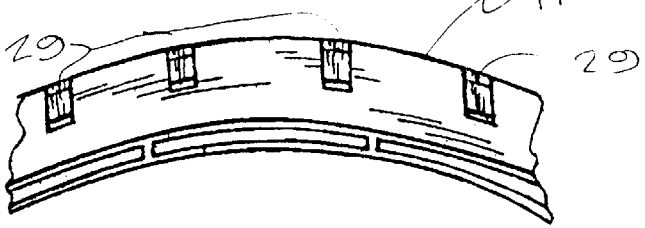
FIG. 6 is a fragmentary sectional view illustrating a portion of the frame and some of the receptacles that receive rollers as attached thereto.

FIG. 5 shows a plurality of rollers 34, 44, 57 in position and after hair 33 of a selected length have been wrapped about each of the rollers as discussed with respect to FIGS. 7, 8 and 9.

Figure 13:
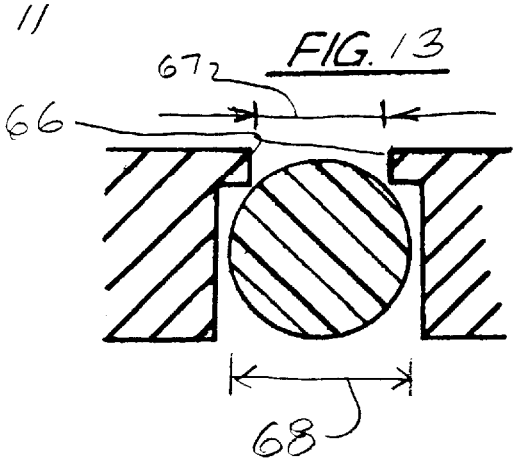
Figure 12:
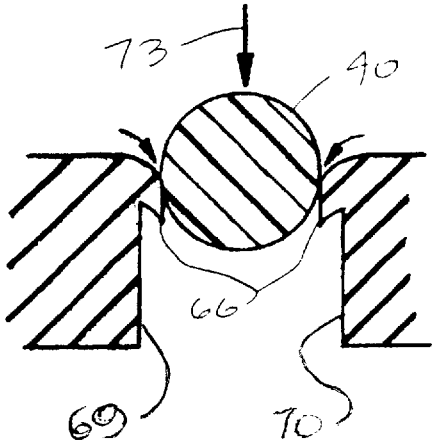

In FIGS. 10–13, the locking arrangement of each of the rollers 34, 44, 57 is shown with the ball 40 fitting into receptacle 29. The receptacle 29 preferably provides side walls 69, 70 each having a flange 66. Flanges 66 are spaced apart a distance defined by gap 67 in FIG. 13. In the preferred embodiment, the ball 40 has a diameter 68 that is larger than the gap 67 between flanges 66. However, the flanges 66 can be of a pliable or deformable material such as rubber, foam or plastic so that they displace or deflect as shown in FIG. 13, enabling the ball 40 to travel in the direction of arrow 73 until it enters a receptacle 29 and reaches the position shown in FIG. 13. In the position shown in FIG. 13, the flanges 66 can act as a retainer to prevent removal of a roller 34, 44, 57 until it is forcibly removed by the user.

Parts List

The following is a list of suitable parts and materials for the various elements of the preferred embodiment of the present invention.

| Part Number | Description |
|---|---|
| 10 | hair curling apparatus |
| 11 | frame |
| 12 | wall |
| 13 | wall |
| 14 | wall |
| 15 | wall |
| 16 | open center |
| 17 | upper surface |
| 18 | upper surface |
| 19 | upper surface |
| 20 | upper surface |
| 21 | lower surface |
| 22 | lower surface |
| 23 | lower surface |
| 24 | lower surface |
| 25 | comb |
| 26 | comb |
| 27 | comb |
| 28 | comb |
| 29 | receptacle |

-continued

| Part Number | Description |
|---|---|
| 30 | user |
| 31 | user's head |
| 32 | scalp |
| 33 | hair |
| 34 | roller |
| 35 | cylindrically shaped body |
| 36 | outer surface |
| 37 | end plate |
| 38 | end plate |
| 39 | stem |
| 40 | ball |
| 41 | stem |
| 42 | ball |
| 43 | band |
| 44 | roller |
| 45 | cylindrically shaped body |
| 46 | outer surface |
| 47 | end plate |
| 48 | end plate |
| 49 | stem |
| 50 | ball |
| 51 | stem |
| 52 | ball |
| 53 | sheet |
| 54 | strip |
| 55 | strip |
| 56 | arrow |
| 57 | roller |
| 58 | cylindrically shaped body |
| 59 | outer surface |
| 60 | end plate |
| 61 | end plate |
| 62 | attachment |
| 63 | attachment |
| 64 | arrow |
| 65 | arrow |
| 66 | flange |
| 67 | gap |
| 68 | diameter |
| 69 | side wall |
| 70 | side wall |
| 71 | fabric cover |
| 72 | gap |

The foregoing embodiments are presented by way of example only; the scope of the present invention is to be limited only by the following claims:

What is claimed is:

1. A hair curling apparatus comprising:

a) a frame having an open center, the frame having a lower surface that is shaped to conform generally to the head of a user and an upper surface having a plurality of receptacles thereon;

b) the frame has a first pair of generally parallel side walls and a second pair of generally parallel side walls, and the receptacles are provided on all of the side walls c) a plurality of rollers that removably attach to the frame by enraging either pair of parallel side walls, each roller having opposed end portions that engage receptacles of the frame when a roller is attached to the frame; and d) wherein a majority of each roller occupies the open center during use.

2. A method of curling hair with a frame and a plurality of curlers that are removably attachable to the frame, comprising the steps of:

a) providing a frame having an open center that is free of partitions and receptive of a plurality of curlers, the frame being configured to conform to the head of a user and including a plurality of attachment portions that are receptive of curler end portions, the attachment positions providing multiple locations for selectively attaching one or more selected curlers;

b) extending a portion of the user's hair through the open center of the frame;

c) curling selected portions of the user's hair that extends through the frame open center to selected of the curlers; and d) attaching the curlers to the frame at selected positions on the frame, wherein a majority of the length of each curler occupies the open center of the frame after attachment to the frame.

3. The method of claim 1 further comprising the step of allowing the frame to bend so that it can flex and thereby conform the user's head.

4. The method of claim 1 wherein the attachment portions on the frame are receptacles, and further comprising the steps of providing projecting attachment portions on the ends of the curlers, and placing the projecting attachment portions in the receptacles in step "d".

5. The method of claim 1 wherein the frame is of a flexible material.

6. The method of claim 1 wherein the frame is generally rectangular in shape.

7. The method of claim 1 wherein the frame open center is generally rectangular in shape.

8. The method of claim 1 wherein the rollers are of differing diameters.

9. The method of claim 1 further comprising the step of providing attachment portions on each roller that grip the user's hair.

* * * * *